US006711829B2

(12) United States Patent
Sano et al.

(10) Patent No.: US 6,711,829 B2
(45) Date of Patent: Mar. 30, 2004

(54) METHOD FOR MEASURING WORK PORTION AND MACHINING METHOD

(75) Inventors: Shoichi Sano, Gamagori (JP); Masahiro Ido, Kariya (JP); Kikutoshi Okada, Kariya (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/956,939

(22) Filed: Sep. 21, 2001

(65) Prior Publication Data

US 2002/0066197 A1 Jun. 6, 2002

(30) Foreign Application Priority Data

Sep. 29, 2000 (JP) ..... 2000-301323

(51) Int. Cl.[7] ..... G01B 5/10

(52) U.S. Cl. ..... 33/549; 33/555.1; 33/543; 33/550; 451/5; 451/9; 451/10; 451/49

(58) Field of Search ..... 33/542, 543, 548, 33/549, 550, 551, 552, 553, 555, 555.1, 555.3; 451/5, 14, 17, 49, 62, 299, 307, 143, 907, 10

(56) References Cited

U.S. PATENT DOCUMENTS 3,664,066 A * 5/1972 Clark ..... 451/14
4,356,850 A * 11/1982 Halgrimson et al. .... 144/209 R
4,712,332 A * 12/1987 Smith ..... 451/5

FOREIGN PATENT DOCUMENTS

JP 2000-94322 4/2000
JP 2000-127038 5/2000

* cited by examiner

*Primary Examiner*—Diego Gutierrez
*Assistant Examiner*—Travis Reis
(74) *Attorney, Agent, or Firm*—Oblon, Spivak, McClelland, Maier & Neustadt, P.C.

(57) ABSTRACT

A method for measuring the diameter and eccentricity of a crankpin of a crankshaft which is ground on a grinding machine. A reference plate is provided on a headstock, which is disposed on a table to support the crankshaft. A measurement apparatus having a probe is disposed on a wheel head. Through movements of the table and the wheel head, the probe is first brought into contact with a reference surface of the reference plate, and is then brought into contact with the outer circumferential surface of the crankpin at outermost and innermost points. The distances between the reference surface and the outermost and innermost points are measured, and the diameter and eccentricity of the crankpin are calculated on the basis of the measured distances and the position of the reference surface.

6 Claims, 8 Drawing Sheets

METHOD FOR MEASURING WORK PORTION AND MACHINING METHOD

The disclosure of Japanese Patent Application No. 2000-301323 filed on Sep. 29, 2000 including the specification, drawings and abstract are incorporated herein by reference in its entirety.

BACKGROUND OF THE INVENTION

1. Field of the Invention

The present invention relates to a measuring method for measuring the eccentricity or diameter of a work portion (i.e., a portion undergoing machining) of a workpiece, which portion is provided eccentrically with respect to the rotation center of the workpiece and has a circular cross section, as well as to a machining method capable of correcting a machining program on the basis of the measured eccentricity or diameter.

2. Description of the Related Art

When a workpiece is machined by use of a machine tool, the machining of the workpiece is sometimes effected, while the dimension or the like of the workpiece is measured by use of a measurement unit mounted on the machine tool. In particular, when a crankpin of a crankshaft serving as a workpiece is ground while the crankshaft is rotated about the journals of the crankshaft, a following-type size-measurement unit produced by, for example, Marposs S.P.A. (Italy) is typically used for measuring the diameter of the crankpin, which revolves about the journals. Such a following-type size-measurement unit is disclosed in, for example, Japanese Patent Application Laid-Open (kokai) No. 2000-127038.

The following-type size-measurement unit will be described with reference to FIG. 10. FIG. 10 shows a case in which the radius of a crankpin 108 ground on a cylindrical grinder 100 which has a grinding wheel 101 is measured by use of a following-type size-measurement unit 103. The following-type size-measurement unit 103 is attached to a support member 104 mounted on a wheel head 102 of the cylindrical grinder 100 in such a manner that the size-measurement unit 103 is swingable about a rotary shaft 105. The size-measurement unit 103 can be moved from a standby position indicated by an alternate long and two short dashes line in FIG. 10 to a position indicated by a solid line in FIG. 10 at which the size-measurement unit 103 measures the size of the revolving crankpin 108.

The measurement head of the size-measurement unit 103 has a V-block 106. A probe 107 is supported by a shaft passing through the center of a V-groove portion of the V-block 106 and is urged forward by an unillustrated spring in such a manner that the probe 107 can be retreated. The amount of axial movement of the probe 107 is detected electrically, and an electrical signal corresponding thereto is output from the measurement head.

When the crankpin 108 is to be measured, as indicated by the solid line, the V-block 106 is brought into contact with the outer circumference of the crankpin 108, so that the crankpin 108 comes into contact with the V-block 106 at two locations. At this time, the probe 107 comes into contact with the outer circumference of the crankpin 108 due to the restoration force of the unillustrated spring. Subsequently, the radius of the crankpin 108 is obtained from the geometric shape of the V-block 106 and the position of the probe 107 in contact with the crankpin 108, which is in contact with the V-block 106.

However, the conventional following-type size-measurement unit is expensive.

Further, since only the radius of a work portion can be measured, the diameter of the work portion must be calculated from the measured radius. In this case, a greater error is produced as compared with the case in which the diameter of the work portion is measured directly.

Moreover, the size of the V-groove portion of the V-block 106 and the swing support mechanism employed for supporting the V-block 106 impose limitations on the measurable workpiece diameter and measurable crankshafts, resulting in a narrow measurement range.

SUMMARY OF THE INVENTION

In view of the foregoing, an object of the present invention is to provide a measuring method which accurately measures the eccentricity and/or diameter of a work portion within a widened range at low cost.

Another object of the present invention is to provide a machining method capable of correcting a machining program on the basis of the eccentricity and/or diameter measured by the measuring method.

The present invention provides a work-portion measuring method for measuring a diameter of a cylindrical work portion of a workpiece mounted on a machine tool, the work portion being concentric with a rotation center of the workpiece, the method comprising the steps of: setting a first distance between a rotation center of the workpiece and a reference point provided on the machine tool; measuring a second distance between the reference point and an outer circumferential surface of the work portion; and obtaining the diameter of the work portion on the basis of the first and second distances.

The present invention provides a machining method for machining an outer circumferential surface of a cylindrical work portion of a workpiece in accordance with a machining program, the work portion being concentric with a rotation center of the workpiece, the method comprising the steps of: measuring a diameter of the work portion by the above-described work-portion measuring method; correcting the machining program based on the measured diameter of the work portion; and machining the outer circumferential surface of the work portion in accordance with the corrected machining program.

The present invention provides another work-portion measuring method for measuring a diameter and eccentricity of a cylindrical work portion of a workpiece mounted on a machine tool, the work portion being eccentric with respect to a rotation center of the workpiece, the method comprising the steps of: setting a first distance between a rotation center of the workpiece and a reference point provided on the machine tool; measuring a second distance between the reference point and an innermost point on an outer circumferential surface of the work portion; measuring a third distance between the reference point and an outermost point on the outer circumferential surface of the work portion; and obtaining the diameter and eccentricity of the work portion on the basis of the first, second, and third distances.

The present invention provides a machining method for machining an outer circumferential surface of a cylindrical work portion of a workpiece in accordance with a machining program, the work portion being eccentric with a rotation center of the workpiece, the method comprising the steps of: measuring a diameter and eccentricity of the work portion by the above-described work-portion measuring method; correcting the machining program based on the measured diameter and eccentricity of the work portion; and machining the outer circumferential surface of the work portion in accordance with the corrected machining program.

In the measuring method of the present invention, since the diameter and/or eccentricity is measured on the basis of distances, a measurement apparatus used in the method is required to detect distance only. Therefore, a contact-type measurement apparatus or any other simple measurement apparatus can be used in order to reduce cost. In addition, the measuring method of the present invention provides higher measurement accuracy as compared with conventional measuring methods.

In the machining methods of the present invention, since the machining program is corrected on the basis of the measured diameter and/or eccentricity of the work portion, the work portion can be finished to higher accuracy.

The machining methods of the present invention preferably comprise an additional step of comparing the measured diameter or eccentricity of the work portion with a tolerance in order to judge whether the work portion is good. In this case, properness of machining can be judged easily on the machine.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Figure 1:
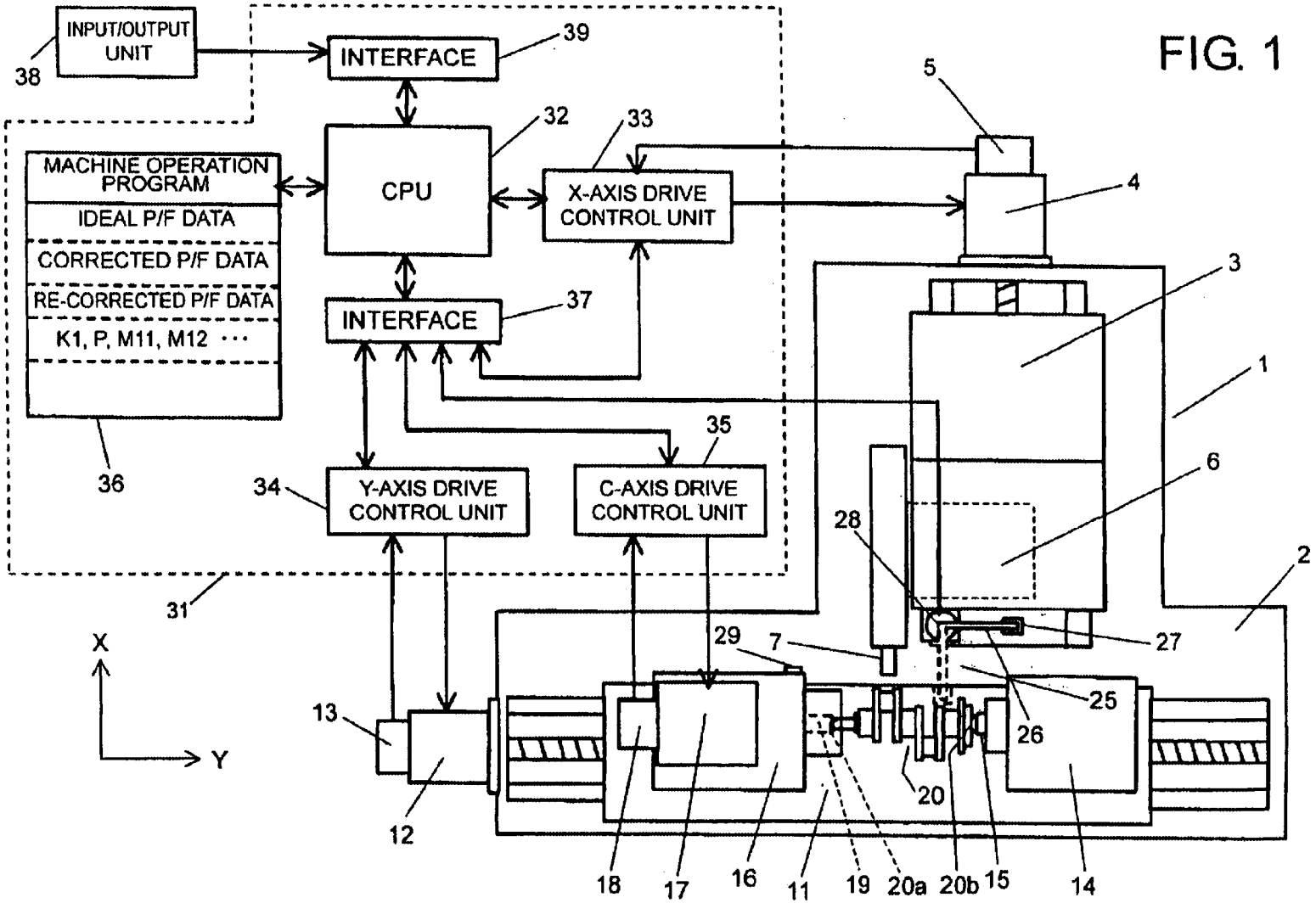
FIG. 1 is a schematic plan view of a grinding machine equipped with a measurement apparatus used in a work-portion measuring method according to the present invention.

A first embodiment of the present invention will be described with reference to FIGS. 1 to 4. The present embodiment exemplifies the case in which an outer circumferential portion of each of crankpins of a crankshaft 20 is ground by a grinding machine 1. The crankshaft 20 (hereinafter referred to as a "workpiece") includes journals and crankpins (work portions) eccentrically connected to the journals via crank arms. Each crankpin has a circular cross section, and its outer circumference surface is ground. FIG. 1 is a schematic plan view of the grinding machine 1 in which a measurement apparatus 25 is disposed on a wheel head 3. The directions of movement of the wheel head 3 and a table 11 of the grinding machine 1 will be referred to as X-axis and Y-axis directions, respectively, as shown by arrows in FIG. 1.

The wheel head 3 and the table 11 are mounted on a bed 2 in such a manner that the wheel head 3 is movable along the X-axis direction, and the table 11 is movable along the Y-axis direction.

Specifically, an X-axis motor 4 is disposed on the bed 2. The X-axis motor 4 is drivingly coupled to the wheel head 3 via an X-axis feed screw connected to the X-axis motor 4 so as to move the wheel head 3 along slide guide surfaces which extend along the X-axis direction. An X-axis encoder 5 is attached to the X-axis motor 4. Therefore, the position of the wheel head 3 is detected by the X-axis encoder 5.

A grinding wheel 7 is rotatably supported on the wheel head 3; and a wheel motor 6 for rotating the grinding wheel 7 is built in the wheel head 3 together with an unillustrated bearing potion. A CBN grinding wheel is used for the grinding wheel 7.

A Y-axis motor 12 is disposed on the bed 2. The Y-axis motor 12 is drivingly coupled to the table 11 via a Y-axis feed screw connected to the Y-axis motor 12 so as to move the table 11 along slide guide surfaces which extend along the Y-axis direction. A Y-axis encoder 13 is attached to the Y-axis motor 12. Therefore, the position of the table 11 is detected by the Y-axis encoder 13.

A headstock 16 and a tailstock 14 are disposed on the table 11. The opposite ends 20*a* and 20*b* of the workpiece 20 are supported by a center 19 of the headstock 16 and a center 15 of the tailstock 14 in such a manner that the workpiece 20 is sandwiched between the centers 15 and 19, and is clamped and driven by a rotary chuck provided on the headstock 16. A C-axis motor 17 for rotating the rotary chuck or the workpiece 20 is disposed on the headstock 16. A C-axis encoder 18 is attached to the C-axis motor 17. Further, a reference plate 29 is attached to a side surface of the headstock 16 (on the side where a measurement apparatus 25, which will be described later, is present in FIG. 1). The reference plate 29 has a reference surface for determining a reference point.

Figure 2:
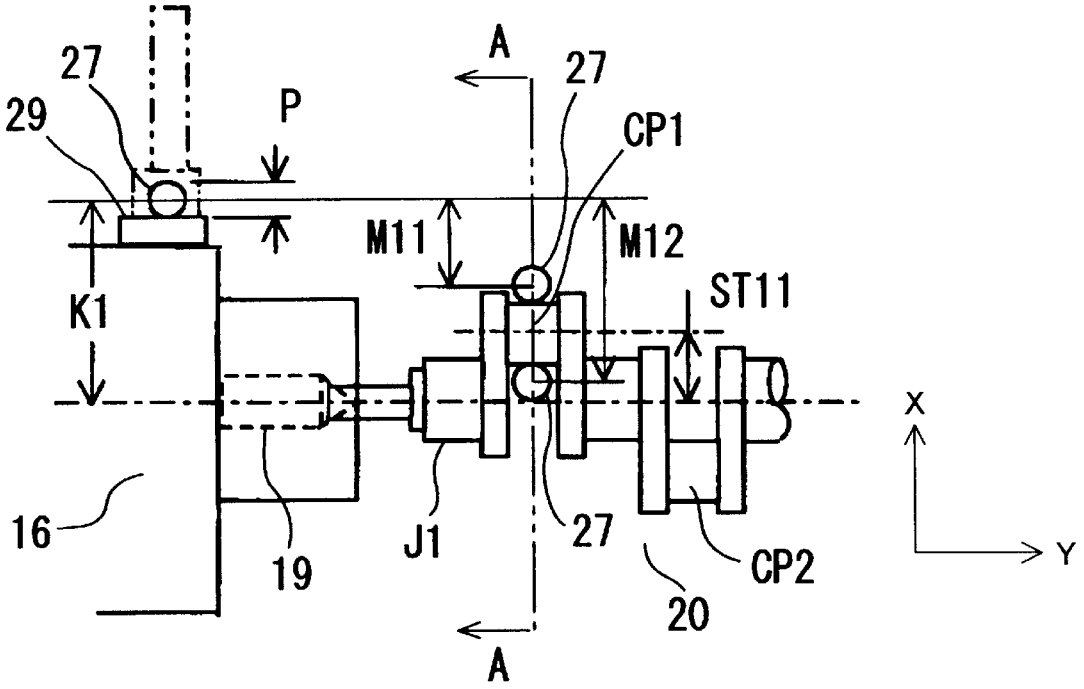
FIG. 2 is an illustration showing a first embodiment of the work-portion measuring method of the present invention.

The measurement apparatus 25 of a contact operation type is attached to the front face of the wheel head 3. The measurement apparatus 25 includes a probe 27 and a measurement head 26, which supports the probe 27. The probe 27 is brought into contact with an outer circumferential surface (work surface) of the crankpin (work portion) of the workpiece 20 to be measured, and tilts as a result of the contact. The measurement head 26 outputs a contact signal (ON signal) when the probe 27 tilts by a predetermined amount. As shown in FIG. 2, the tip end of the probe 27 is formed into the shape of a sphere having a diameter P. When the workpiece 20 is being ground, in order to avoid interference with the workpiece 20 or the like, the measurement apparatus 25 can be swung about a shaft 28 to the standby position indicated by a solid line in FIG. 1 (the measurement position is shown by a broken line in FIG. 1).

Next, a control apparatus 31 for the grinding machine 1 will be described. In the present embodiment, the control apparatus 31 is a computerized numerical controller (CNC). The computerized numerical controller (hereinafter referred to as a "controller") 31 includes a central processing unit (CPU) 32, an X-axis drive control circuit 33, a Y-axis drive control circuit 34, and a C-axis control circuit 35, and a storage unit 36 (e.g., RAM, ROM, HDD) for storing a machining operation program and data. The storage unit 36 is connected to the CPU 32 via a bus.

The X-axis drive control circuit 33 is connected to the X-axis motor 4 and the X-axis encoder 5. The Y-axis drive control circuit 34 is connected to the Y-axis motor 12 and the Y-axis encoder 13. The C-axis control circuit 35 is connected to the C-axis motor 17 and the C-axis encoder 18.

The X-axis drive control circuit 33, the Y-axis drive control circuit 34, the C-axis control circuit 35, and the measurement apparatus 25 are connected to the CPU 32 via an interface 37 and the bus.

The storage unit 36 stores a machining operation program which the grinding machine 1 requires for performing grinding operation. In addition to the machining operation program, the storage unit 36 stores ideal profile (P/F) data obtained through calculation on the basis of which trial grinding is performed; corrected profile (P/F) data which are obtained by correcting the ideal profile (P/F) on the basis of the result of the trial grinding and which are used in actual grinding operation; and re-collected profile (P/F) data which are obtained by correcting the corrected profile (P/F) in a manner as described below.

An input/output unit 38, which includes display means for displaying various data, such as a CRT, and input means such as numeric keys, is connected to the CPU 32 via an interface 39 and the bus.

Figure 4:
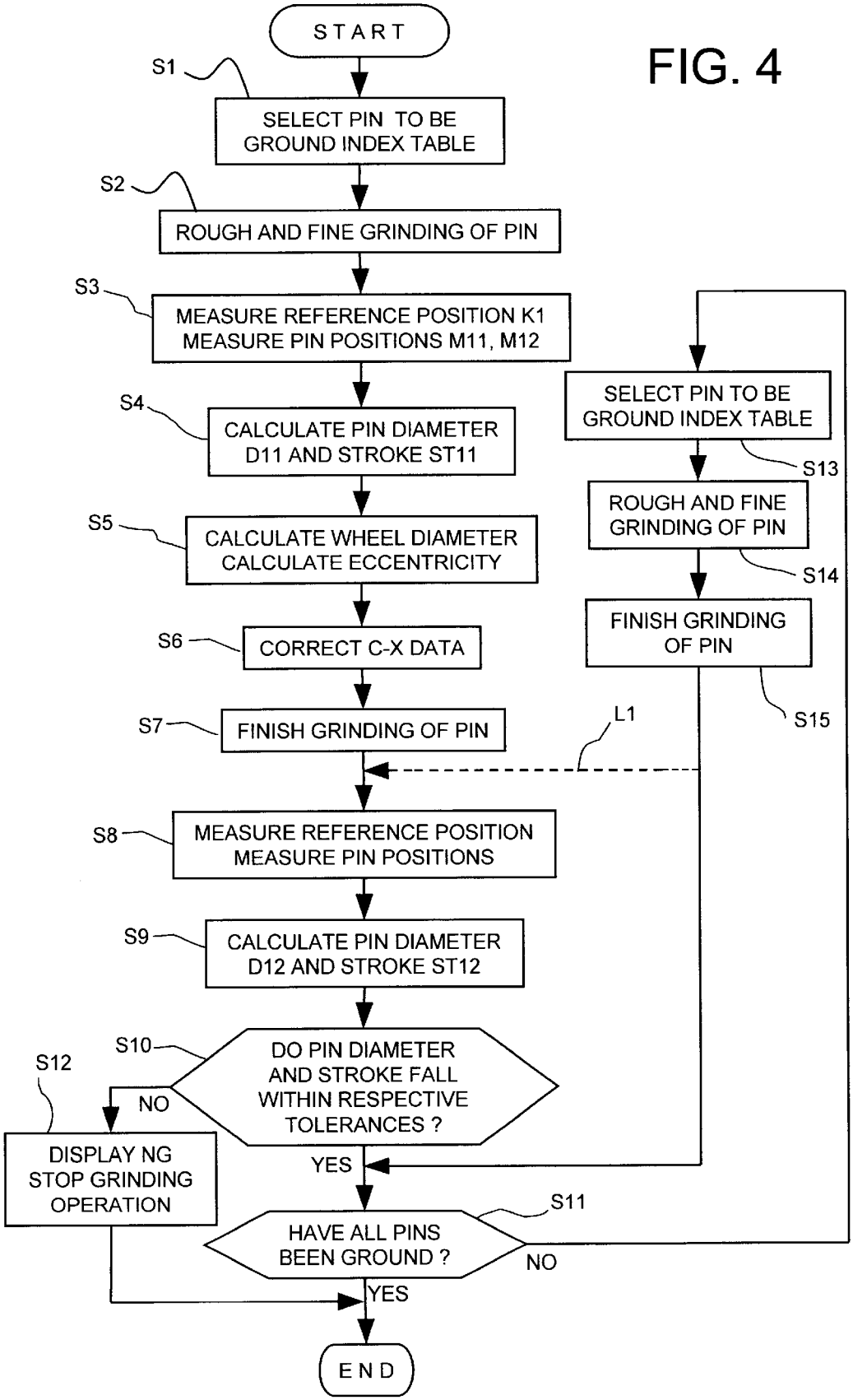
FIG. 4 is a flowchart showing the operation for grinding a crankpin of a workpiece, while measuring the eccentricity and diameter of the crankpin by the first embodiment of the work-portion measuring method of the present invention.

Next, with reference to FIGS. 2 to 4, there will be described an operation for grinding a crankpin CP1 (work portion) of the workpiece 20, while measuring the eccentricity and diameter of the crankpin CP1 by a first embodiment of the work-portion measuring method of the present invention. FIG. 2 is an illustration showing the first embodiment of the work-portion measuring method of the present invention. FIGS. 3(*a*) to 3(*f*) are illustrations showing a method for measuring distances used in the first embodiment of the work-portion measuring method of the present invention. Notably, each of FIGS. 3(*a*) to 3(*f*) is a sectional view taken along line A—A in FIG. 2. FIG. 4 is a flowchart showing the operation for grinding the crankpin CP1 (work portion), while measuring the eccentricity and diameter of the crankpin CP1 by the first embodiment of the work-portion measuring method of the present invention. The workpiece 20 to be machined has such a configuration that the crankpin CP1 has a circular cross section, and the rotation center coincides with the centers of the journals and is not present in a circular area corresponding to the cross section of the crankpin CP1.

Among the X-axis, Y-axis, and Z-axis directions shown in FIGS. 2 to 4, the X-axis and Y-axis directions are the same as those shown in FIG. 1, and the Z-axis direction is the direction of height of the grinding machine 1.

A machining operation program necessary for grinding the crankpin CP1 on the grinding machine 1 is stored in the storage unit 36 apart from the above-described profile file.

When this machining operation program is started, in first step S1, the table 11 is moved by the Y-axis motor 12 to a position at which the grinding wheel 7 faces the crankpin CP1 to be ground.

In next step S2, the workpiece 20 is rotated by the C-axis motor 17, and the wheel head 3 is advanced to grind the crankpin CP1. Since the workpiece 20 is rotated with its opposite ends 20*a* and 20*b* supported, the crankpin CP1 undergoes planetary motion. Therefore, the wheel head 3 must be advanced and retreated in synchronism with rotation of the C-axis motor 17 on the headstock 16 such that the grinding wheel 7 always remains in contact with the outer circumferential surface of the crankpin CP1.

Specifically, the corrected profile (P/F) data, which define a rotational position of the workpiece 20 and a position of the wheel head 3 for each unit rotational angle (e.g., 0.5°) of the workpiece 20, are used in order to control rotation of the workpiece 20 and the advancement/retraction movement of the wheel head 3. During the course of this motion control, the rotational angle of the crankpin CP1 is detected from the output of the C-axis encoder 18, the position of the wheel head 3 is detected from the output of the X-axis encoder 5, and feedback control is effected in such a manner that the rotational angle of the crankpin CP1 and the position of the wheel head 3 change according to the corrected profile (P/F) data. Thus, the wheel head 3 is advanced and retreated in synchronism with the planetary motion of the crankpin CP1, so that the grinding wheel 7 maintains contact with the outer circumferential surface of the revolving crankpin CP1 and grinds the outer circumference surface of the crankpin CP1 continuously.

Such motions in the C and X axes effected through 2-axis simultaneous control are continued, while the crankpin CP1 is ground, and are superposed on a cutting feed of the wheel head 3 toward the rotational axis of the workpiece 20, which is also effected during the grinding operation. Therefore, while being advanced gradually toward the crankpin CP1 for effecting cutting, the grinding wheel 7 is advanced and retreated in such a manner that the contact with the crankpin CP1 is always maintained, irrespective of the planetary angle of the crankpin CP1.

In step S2, the crankpin CP1 is rough-ground at a relatively high cutting feed rate in the above-described manner. When the wheel head 3 reaches a rough-grinding end position set within the machining operation program, the cutting feed rate is switched to a relatively slow fine-grinding rate, and fine grinding is performed. When the wheel head 3 reaches a fine-grinding end position set within the machining operation program, the fine grinding is ended. Thus, the cutting feed of the wheel head 3 is stopped, and the workpiece 20 is rotated one turn or several turns in order to effect spark-out grinding. Subsequently, the wheel head 3 is retreated to the retreated position, and the workpiece 20 is stopped at such an angle position that the crankpin CP1 is indexed to a measurement position shown in FIG. 3(*a*).

Notably, the ideal profile (P/F) data are obtained through geometric calculation in consideration of various parameters such as the diameters of the crankpins CP1 and CP2, the diameter of the grinding wheel, and the pin stroke; and define each rotational angle of the workpiece 20 and a position of the grinding wheel 7 corresponding to each rotational angle for grinding the crankpins CP1 and CP2 to a target diameter and securing a desired roundness. Meanwhile, the corrected profile (P/F) data are data which are obtained by compensating the ideal profile (P/F) data for errors which are produced due to distortion of the mechanical system and the follow delay of the servo system when the workpiece 20 is ground on a trial basis by use of the ideal profile (P/F) data.

In next step S3, an outermost-point distance M11 and an innermost-point distance M12 as measured from a known reference position K1 are measured by use of the measurement apparatus 25.

First, the probe 27 of the measurement apparatus 25 is swung about the shaft 28 (by about 90 degrees in FIG. 1) from the standby position indicated by the solid line in FIG. 1 to the measurement position indicated by the broken line in FIG. 1. As shown FIG. 3(*a*), when the workpiece 20 is indexed at the measurement position, the rotational angle of the crankshaft (workpiece) 20; i.e., the rotational angle of the main spindle, is adjusted in such a manner that a point on the outer circumferential surface of the crankpin CP1 which is most remote from the center axis (hereinafter referred to as an "outermost point") and a point on the outer circumferential surface of the crankpin CP1 which is the closet to the center axis (hereinafter referred to as an "innermost point") are both located on the X-axis line. The rotational angle of the crankshaft (workpiece) 20 shown in FIG. 3(*a*) is defined as a rotational angle of 0 degrees. Further, the rotational angle of the crankshaft (workpiece) 20 shown in FIG. 3(*c*) is referred to as a rotational angle of 270 degrees.

Subsequently, the table 11 is moved along the Y-axis direction by the Y-axis motor 12, and the wheel head 3 is moved along the X-axis direction by the X-axis motor 4 until the measurement apparatus 25 outputs an ON signal. Thus, the probe 27 of the measurement apparatus 25 is brought into contact with the reference surface of the reference plate 29 provided on the side surface of the headstock 16 (FIG. 3(*a*)). This position will be used as a reference point. At this point, the X-axis position of the wheel head 3 is detected from the output of the X-axis encoder 5 and is stored in the storage unit 36.

In the case of the measurement apparatus 25 used in the present embodiment, the center of the probe 27 is used as a measurement position. Therefore, the distance between the main spindle center 19 of the headstock 16 and the reference position K1 as measured along the X-axis direction is the distance (reference distance) between the main spindle center 19 of the headstock 16 and the center of the probe 27 in contact with the reference point of the reference plate 29. This reference distance is a known value which is stored in the storage unit 36 as K1.

Subsequently, the wheel head 3 and the table 11 are moved by the X-axis motor 4 and the Y-axis motor 12, respectively, such that the probe 27 comes into contact with the outermost point (a point which is most remote from the center axis) on the outer circumferential surface of the crankpin CP1. The advance movement of the wheel head 3 is stopped at a position where the measurement apparatus 25 outputs an ON signal (FIG. 3(*b*)). Notably, the "outermost point" is not necessarily a point which is most remote from the center axis; the term "outermost point" encompasses a point which is not most remote from the center axis. At this time, the amount of movement from the reference point to the outermost point along the X-axis direction is detected from the output of the X-axis encoder 5. The distance from the reference point to the outermost point along the X-axis direction is stored in the storage unit 36 as the outermost-point distance M11.

Subsequently, the probe 27 is separated from the crankpin CP1, and the workpiece 20 is rotated by the C-axis motor 17 in such a manner that the crankpin CP1 becomes lower in position than the main spindle center 19 (FIG. 3(*c*)). In the present embodiment, the workpiece 20 is rotated clockwise from the position shown in FIG. 3(*a*) by about 90 degrees.

In this state, the wheel head 3 is advanced along the X-axis direction by the X-axis motor 4 (FIG. 3(*c*)).

When the probe 27 has completely passed over the crankpin CP1, the wheel head 3 is stopped.

Next, the crankpin CP1 is returned to the initial position shown in FIG. 3(*a*). In the present embodiment, the workpiece 20 is rotated counterclockwise by 90 degrees (FIG. 3(*d*)).

Subsequently, the wheel head 3 is retracted by the X-axis motor 4, such that the probe 27 comes into contact with the innermost point (a point which is the closest to the center axis) on the outer circumferential surface of the crankpin CP1. The retraction movement of the wheel head 3 is stopped at a position where the measurement apparatus 25 outputs an ON signal (FIG. 3(*e*)). Notably, the "innermost point" is not necessarily a point which is the closet to the center axis; the term "innermost point" encompasses a point which is not the closest to the center axis. At this time, the amount of movement from the reference point to the innermost point along the X-axis direction is detected from the output of the X-axis encoder 5. The distance from the reference point to the innermost point along the X-axis direction is stored in the storage unit 36 as the innermost-point distance M12.

Subsequently, the probe 27 is separated from the crankpin CP1, and the workpiece 20 is rotated by the C-axis motor 17 in such a manner that the crankpin CP1 becomes lower in position than the main spindle center 19. For example, the workpiece 20 is rotated clockwise by 90 degrees. In this state, the wheel head 3 is retracted along the X-axis direction by the X-axis motor 4 (FIG. 3(*f*)). When the probe 27 has completely passed over the crankpin CP1, the wheel head 3 is stopped.

In subsequent step S4, the diameter D11 and eccentricity (the amount of offset from the journals) ST11 of the crankpin CP1 are obtained on the basis of the outermost-point distance M11 and the innermost-point distance M12, which were measured in step S3, and the reference distance K1 and the spherical diameter P of the probe 27, which are previously stored values. The diameter D11 of the crankpin CP1 can be obtained by, for example, the formula D11=M12−M11−P. The offset amount (eccentricity) ST11 of the crankpin CP1 can be obtained by, for example, the formula ST11=K1−M11−(D11+P)/2.

The diameter D1 and the offset amount (eccentricity) ST11 obtained in step S4 are used in step S6 in order to re-correct the corrected profile (P/F) data used for the above-described rough grinding and fine grinding.

Before the re-correction processing, in step S5, the diameter of the grinding wheel is calculated. Specifically, the error between the diameter D11 of the crankpin CP1 obtained in step S4 and a target diameter of the crankpin CP1 to be obtained through fine grinding is obtained, and the diameter of the grinding wheel set in a calculation formula which is used for preparing the corrected profile (P/F) data is corrected by the error, so that the corrected diameter of the grinding wheel is calculated.

Further, in step S5, a corrected eccentricity is calculated. Specifically, the error between the actual eccentricity ST11 of the crankpin CP1 obtained in step S4 and a target eccentricity is obtained, and the eccentricity set in the calculation formula which is used for preparing the corrected profile (P/F) data is corrected by the error, so that the corrected eccentricity is calculated.

The thus-obtained corrected wheel diameter and corrected eccentricity are regarded as values which are determined in total consideration of deformation of the workpiece 20 during the grinding operation, elastic deformation and thermal deformation of the structure and feed mechanism of the grinding machine 1, and delay of the feed serve system.

In step S6, the corrected wheel diameter and corrected eccentricity are substituted into the calculation formula for preparing the corrected profile (P/F) data to thereby create the re-corrected profile (P/F) data (re-corrected C-X data), which are then stored in a re-corrected P/F data area of the storage unit 36.

In subsequent step S7, the crankpin CP1 is subjected to finish grinding (micro grinding, grinding without cutting) performed in accordance with the re-corrected profile (P/F) data obtained in step S6.

When the wheel head 3 is returned to the retreated position after completion of the finish grinding, in step S8, the reference position K1, the outermost-point distance M11, and the innermost-point distance M12 are determined in the same manner as that in step S3.

In subsequent step S9, the diameter D12 and eccentricity ST12 of the crankpin CP1 are obtained in the same manner as that in step S4.

In subsequent step S10, the CPU 32 judges whether the diameter D12 and the eccentricity ST12 obtained in step S9 fall within tolerances set for the respective target values to be attained after completion of the grinding operation. When both the diameter D12 and the eccentricity (stroke) ST12 obtained in step S9 fall within the respective tolerances, the CPU 32 proceeds to step S11. When either one of the diameter D12 and the eccentricity (stroke) ST12 falls outside the respective tolerances, the CPU 32 proceeds to step S12.

In step S12, the CPU 32 feeds to the input/output unit 38 an NG signal indicating that the ground crankpin CP1 is NG; i.e., unsatisfactory. Upon receipt of the NG signal, the input/output unit 38 displays on the display means a message reporting that the ground crankpin CP1 is NG Further, the CPU 32 transmits a machining stop command to the grinding machine 1, so that grinding of a subsequent crankpin CP2 is stopped.

In step S11, the CPU 32 judges whether all crankpins have been ground. When no other crankpins to be ground are present, the CPU 32 ends the processing. When any crankpin to be ground is present, the CPU 32 proceeds to step S13.

In step S13, the table 11 is moved by the Y-axis motor 12 to a position at which the grinding wheel 7 faces the next crankpin CP2 to be ground.

In next step S14, the crankpin CP2 is subjected to rough grinding and fine grinding performed in the same manner as that in step S2. In subsequent step S15, the crankpin CP2 is subjected to finish grinding (micro grinding, grinding without cutting) performed in accordance with the re-corrected profile (P/F) data obtained in step S6 when the crankpin CP1 was ground.

Upon completion of the finish grinding, the CPU 32 proceeds to step S11. In a modified embodiment, the CPU 32 is programmed to proceed from step S15 to step S8 as indicated by line L1, so that the processing in steps S8, S9, and S10 is performed.

Figure 5:
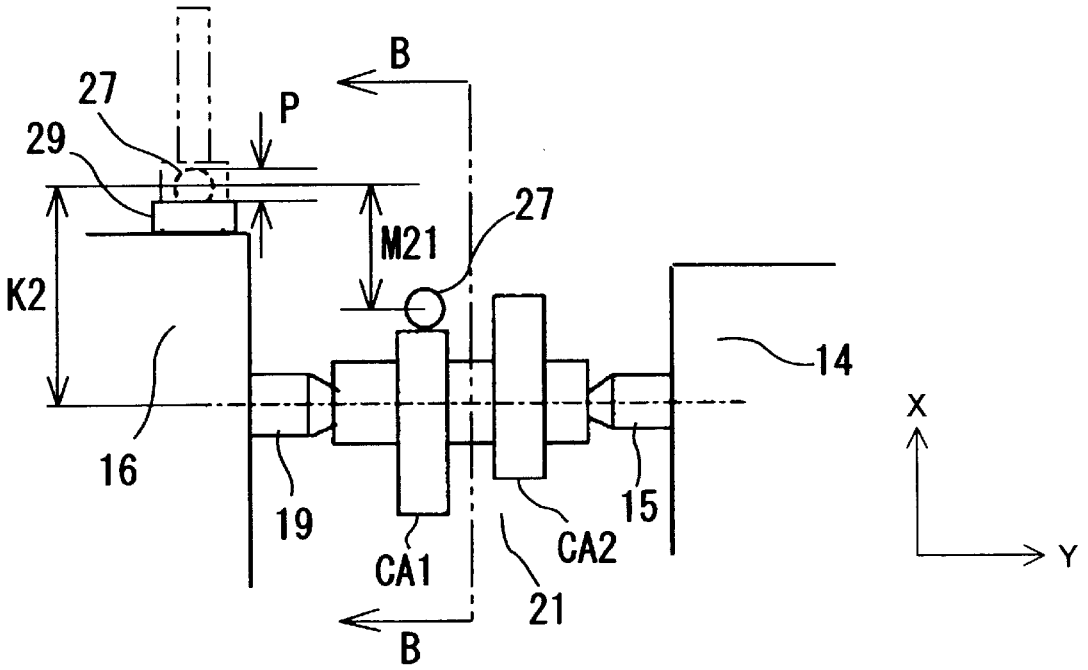
FIG. 5 is an illustration showing a second embodiment of the work-portion measuring method of the present invention.
Figure 3A:
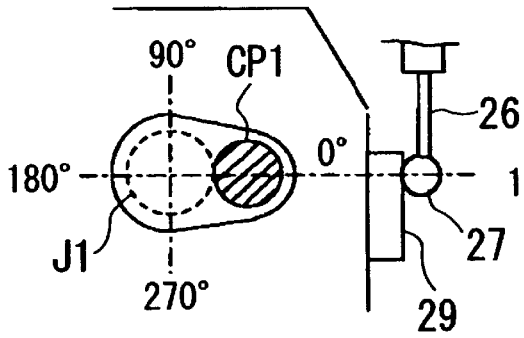
FIGS. 3(*a*) to 3(*f*) are illustrations showing a method for measuring distances used in the first embodiment of the work-portion measuring method of the present invention.
Figure 3B:
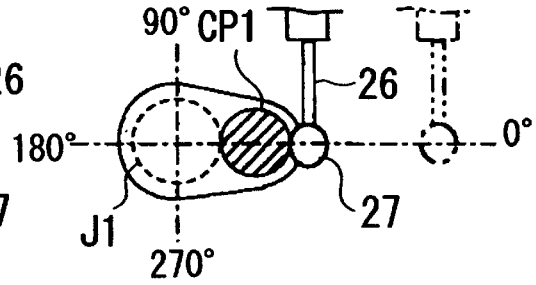
Figure 3C:
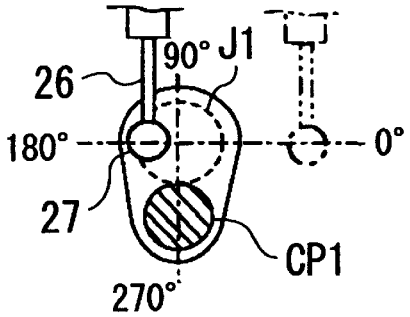
Figure 3D:
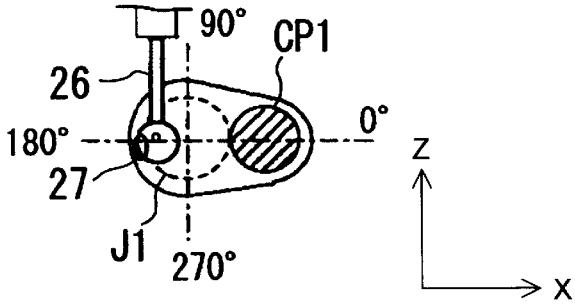
Figure 3E:
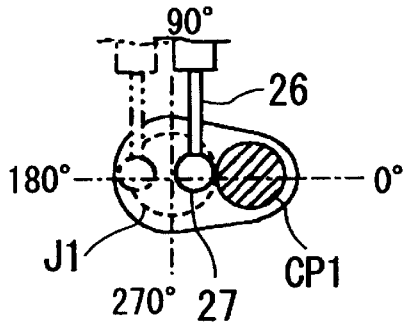
Figure 3F:
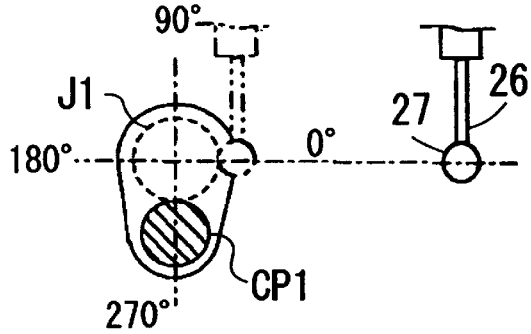
Figure 6A:
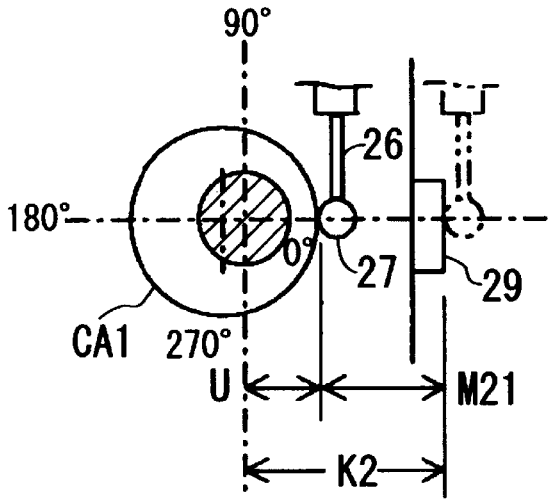
FIGS. 6(*a*) to 6(*c*) are illustrations showing a method for measuring distances used in the second embodiment of the work-portion measuring method of the present invention.
Figure 6B:
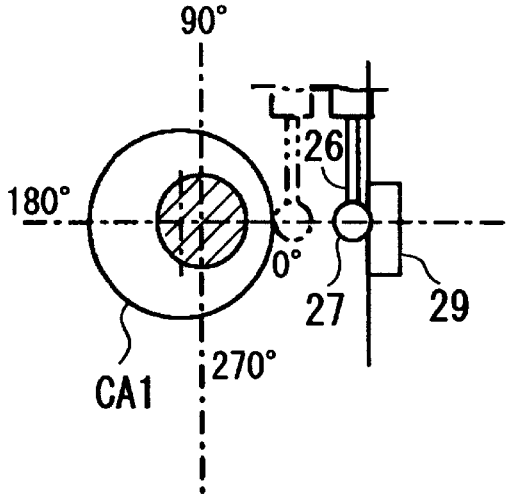
Figure 6C:
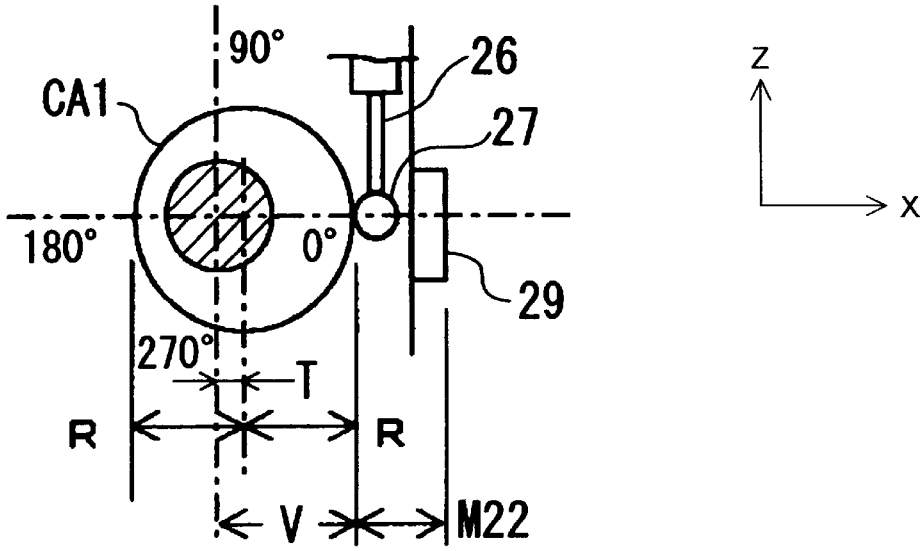
Figure 7:
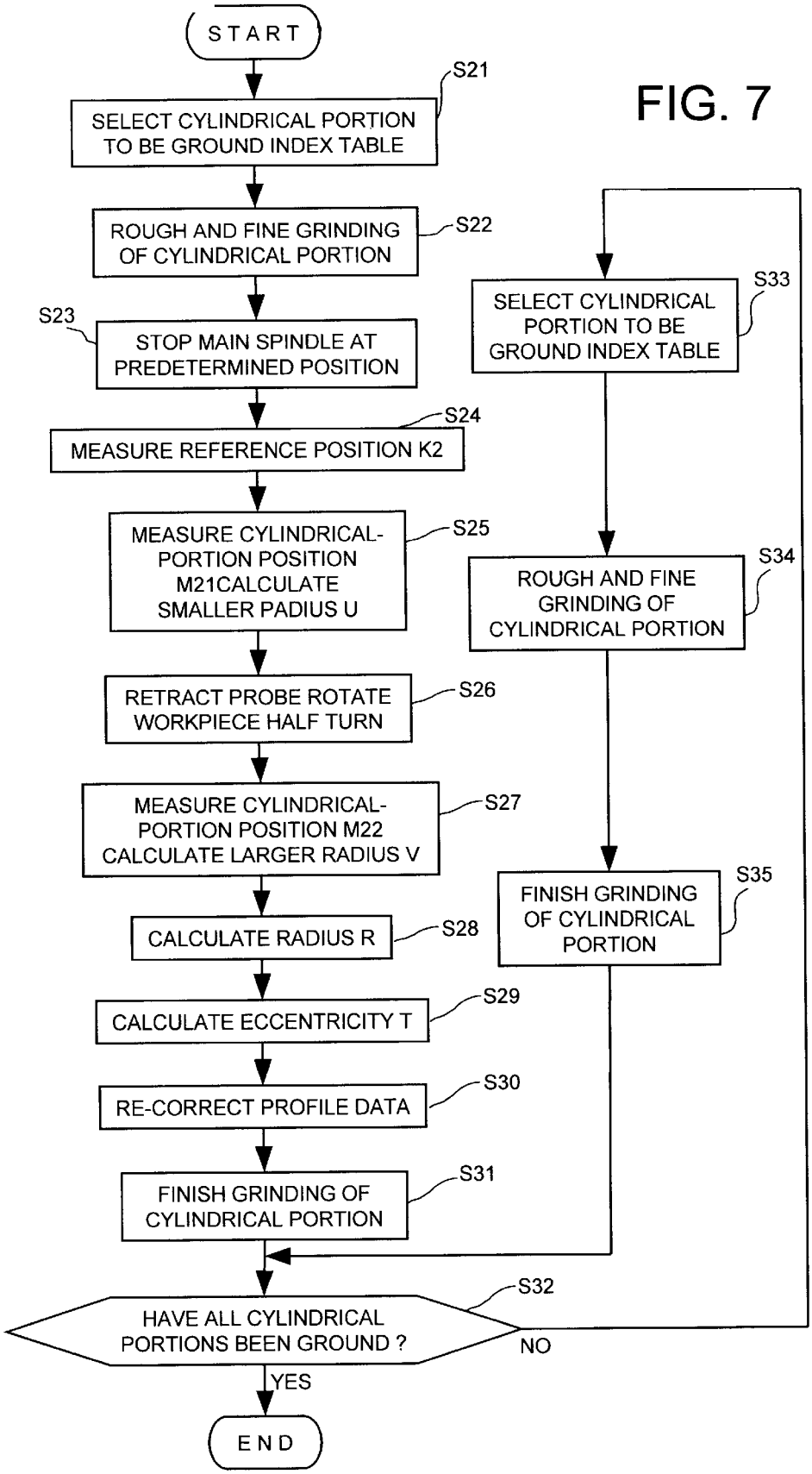
FIG. 7 is a flowchart showing the operation for grinding an eccentric cylindrical portion, while measuring the cylindrical portion by the second embodiment of the work-portion measuring method of the present invention.

Next, a second embodiment of the work-portion measuring method of the present invention will be described with reference to FIGS. 5 to 7. FIG. 5 is an illustration showing the second embodiment of the work-portion measuring method of the present invention. FIGS. 6(*a*) to 6(*c*) are illustrations showing a method for obtaining distance used in the second embodiment of the work-portion measuring method of the present invention. Notably, each of FIGS. 6(*a*) to 6(*c*) is a sectional view taken along line B—B in FIG. 5. FIG. 7 is a flowchart showing the operation for grinding an eccentric cylindrical portion, while measuring the cylindrical portion by use of the measurement apparatus 25. In the present embodiment, a shaft (workpiece) 21 to be machined has eccentric cylindrical portions CA1 and CA2, each having a circular cross section and being eccentric with the rotation center axis of the shaft 21.

A machining operation program which is required to grind the outer circumferential surfaces of the eccentric cylindrical portions CA1 and CA2 of the shaft 21 on the grinding machine 1 is stored in the storage unit 36 in advance.

When the machining operation program shown in FIG. 7 is started, in first step S21, the table 11 is moved by the Y-axis motor 12 to a position at which the grinding wheel 7 faces the eccentric cylindrical portion CA1 to be ground first.

In next step S22, the workpiece 21 is rotated by the C-axis motor 17, and the wheel head 3 is advanced to grind the eccentric cylindrical portion CA1. Although the workpiece 21 is rotated about its center axis, the center of the eccentric cylindrical portion CA1 is eccentric with respect to the center axis (rotation center) of the workpiece 21. Therefore, the wheel head 3 is advanced and retreated in synchronism with rotation of the C-axis motor 17 on the headstock 16 such that the grinding wheel 7 is always in contact with the outer circumferential surface of the eccentric cylindrical portion CA1. This advancement/retreat motion is continuously effected in accordance with the corrected profile (P/F) data, while the wheel head 3 is advanced for cutting in accordance with the machining operation program. Specifically, in step S22, the wheel head 3 is fed toward the workpiece 21 for effecting cutting feed, while being advanced and retreated in synchronism with the rotation of the workpiece 21. First, rough grounding is performed at a relatively high cutting-feed rate. When the wheel head 3 reaches a rough-grinding end position, the cutting feed rate is reduced to a relatively low feed rate in order to perform fine grinding. When the wheel head 3 reaches a fine-grinding end position, the cutting feed of the wheel head 3 is stopped, and the workpiece 21 is rotated one turn or several turns in order to effect spark-out grinding. Subsequently, the wheel head 3 is retreated to the retreated position.

In step S23, by means of a function of stopping the main spindle at a constant position, the workpiece 21 is stopped at an angular position which is determined such that the eccentric cylindrical portion CA1 is located at an angular position suitable for measurement. In the present embodiment, as shown in FIG. 6(*a*), the workpiece 21 is stopped at such an angular position that a point on the outer circumferential surface of the eccentric cylindrical portion CA1 which is the closet to the center axis (hereinafter referred to as an "innermost point") and a point on the outer circumferential surface of the eccentric cylindrical portion CA1 which is most remote from the center axis (hereinafter referred to as an "outmost point") are both located on the X-axis line. The rotational angle at which the eccentric cylindrical portion CA1 is oriented as shown in FIG. 6(*a*) is defined as a rotational angle of 0 degrees. Further, the rotational angle at which the eccentric cylindrical portion CA1 is oriented as shown in FIG. 6(*c*) is referred to as a rotational angle of 180 degrees.

In subsequent step S24, the probe 27 of the measurement apparatus 25 is swung from the standby position indicated by the solid line in FIG. 1 to the measurement position indicated by the broken line in FIG. 1. Subsequently, the table 11 is moved by the Y-axis motor 12 to a position at which the probe 27 faces the reference surface of the reference plate 29. In this state, the wheel head 3 is advanced by the X-axis motor 4, and is stopped when the measurement apparatus 25 outputs an ON signal due to contact with the reference plate 29. The stopped position is detected from the output of the X-axis encoder 5 and is stored in the storage unit 36 as a reference point K2.

In step S25, the wheel head 3 and the table 11 are moved by the X-axis motor 4 and the Y-axis motor 12, respectively, such that the probe 27 comes into contact with the innermost point of the eccentric cylindrical portion CA1 (FIG. 6(*a*)). The advance movement of the wheel head 3 is stopped at a position where the measurement apparatus 25 outputs an ON signal. At this time, the distance from the reference point K2 to the innermost point along the X-axis direction is detected from the output of the X-axis encoder 5 and is stored in the storage unit 36 as the innermost-point distance M21.

Further, the CPU 32 calculates the smaller radius (the distance between the rotation center and the innermost point) U on the basis of the known reference distance K2 and the measured innermost-point distance M21 and stores it in the storage unit 36. The smaller radius U can be obtained by, for example, the formula U=K2−M21−P/2.

In step S26, the wheel head 3 is retreated in order to separate the probe 27 from the eccentric cylindrical portion CA1 (probe retraction) (FIG. 6(*b*)), and the workpiece 21 is rotated by 180 degrees (workpiece half-turn rotation) (FIG. 6(*c*)).

In subsequent step S27, the wheel head 3 is moved by the X-axis motor 4 such that the probe 27 comes into contact with the outermost point of the eccentric cylindrical portion CA1. The advance movement of the wheel head 3 is stopped at a position where the measurement apparatus 25 outputs an ON signal. At this time, the distance between the reference point K2 and the outermost point along the X-axis direction is stored in the storage unit 36 as the outermost-point distance M22.

Further, the CPU 32 calculates the larger radius (the distance between the rotation center and the outermost point) V on the basis of the reference distance K2 and the measured innermost-point distance M22 and stores it in the storage unit 36. The larger radius V can be obtained by, for example, the formula V=K2−M22−P/2. After completion of tie measurement of the innermost-point distance M22, the wheel head 3 is returned to the retreated position, and the probe 27 is returned to the standby position.

In subsequent step S28, the radius R of the eccentric cylindrical portion CA1 is obtained from the smaller radius U and the larger radius V obtained in steps S25 and S27. The radius R can be obtained by, for example, the formula R=(U+V)/2.

In step S29, the eccentricity T of the eccentric cylindrical portion CA1 with respect to the rotation center of the workpiece 21 is obtained from the larger radius V and the radius R of the eccentric cylindrical portion CA1, and is stored in the storage unit 36. The eccentricity T can be obtained by, for example, the formula T=V−R.

In step S30, the calculated eccentricity T is compared with a target eccentricity. When the error exceeds the tolerance, profile data which are used for performing simultaneous two-axis control (for the C axis and the X axis) so as to form the eccentric cylindrical portion CA1 on the center shaft are judged to be inaccurate, and the profile data are corrected on the basis of the error. More specifically, the profile data are calculated again, while the eccentricity input value used in the previous calculation is corrected by an amount corresponding to the error. Thus, re-corrected profile (P/F) data which enable attainment of an eccentricity closer to the target eccentricity are obtained and stored in the re-corrected P/F data area of the storage unit 36.

The re-corrected profile (P/F) data are used in step S31 in order to finish-grind the eccentric cylindrical portion CA1. The advancement/retraction motion of the wheel head 3—which is performed in synchronism with rotation of the workpiece 21 and is superposed on the cutting feed for the finish grinding—is controlled on the basis of the re-corrected profile (P/F) data. Thus, the eccentric cylindrical portion CA1 is ground to have the target finish diameter and the target eccentricity.

In subsequent step S32, the CPU 32 judges whether all eccentric cylindrical portions have been ground. When no other eccentric cylindrical portions to be ground are present, the CPU 32 ends the processing. When any eccentric cylindrical portion to be ground is present (e.g., an eccentric cylindrical portion CA2 as shown in FIG. 5), the CPU 32 proceeds to step S33.

In step S33, the table 11 is moved by the Y-axis motor 12 to a position at which the grinding wheel 7 faces the second eccentric cylindrical portion CA2 to be ground. In next step S34, the second eccentric cylindrical portion CA2 is subjected to rough grinding and fine grinding performed in the same manner as in step S22. Since a phase difference of 180 degrees is present between the eccentric cylindrical portions CA1 and CA2, before start of the rough grinding, the workpiece 21 is oriented or indexed to an index angle which is shifted by half a turn from the index angle at which the rough grinding of the eccentric cylindrical portion CA1 was started, so that the smallest radius portion of the eccentric cylindrical portion CA2 is caused to face the grinding wheel 7. The rough grinding is started from such an index angle. During the rough grinding and fine grinding subsequent thereto, in accordance with the re-corrected profile (P/F) data which have been obtained in step S30 through grinding of the first eccentric cylindrical portion CA1, the wheel head 3 is advanced and retracted in synchronism with rotation of the workpiece 21 in such a manner that the advancement/retraction motion of the wheel head 3 is superposed on the cutting feed motion toward the workpiece 21.

Subsequent to the fine grinding, finish grinding is performed in step S35. In this finish grinding as well, the wheel head 3 is advanced and retracted in synchronism with rotation of the workpiece 21 and in accordance with the re-corrected profile (P/F) data. At the end of the finish grinding, the cutting feed of the wheel head 3 is stopped, and the workpiece 21 is rotated one turn or several turns in order to effect spark-out grinding. In this manner, the second eccentric cylindrical portion CA2 has undergone the rough grinding, the fine grinding, and the finish grinding. In the case of the workpiece 21, which has two eccentric cylindrical portions as shown in FIG. 5, in step S32, the CPU 32 judges that all the eccentric cylindrical portions have been ground, and ends the present machining operation program.

Figure 8:
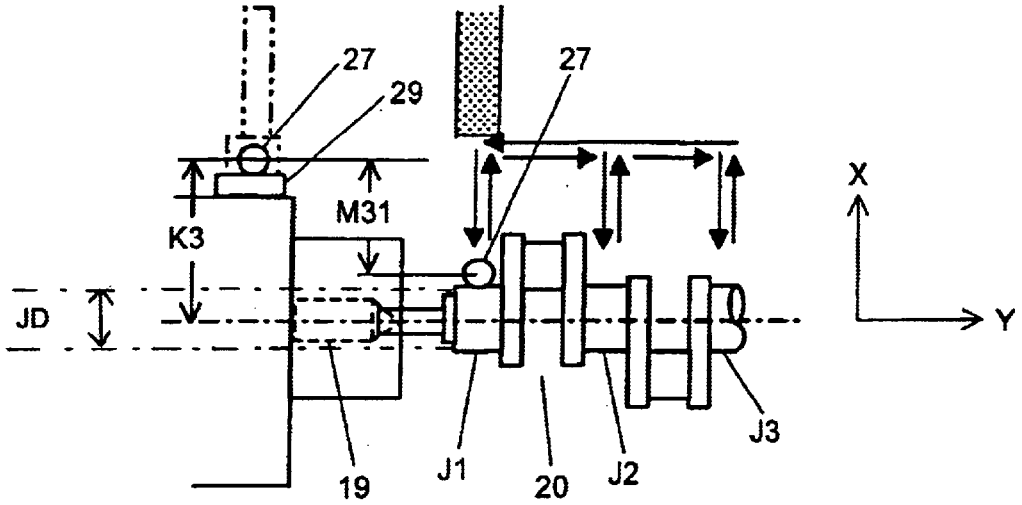
FIG. 8 is an illustration showing a method for measuring distances used in a third embodiment of the work-portion measuring method of the present invention.
Figure 10:
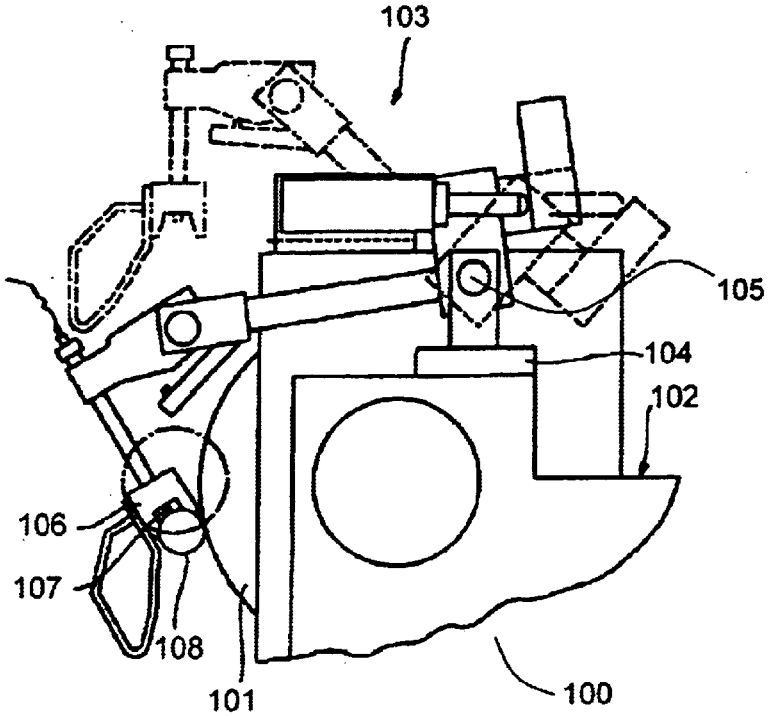
FIG. 10 is a view showing a conventional follow-type size-measurement unit.
Figure 9:
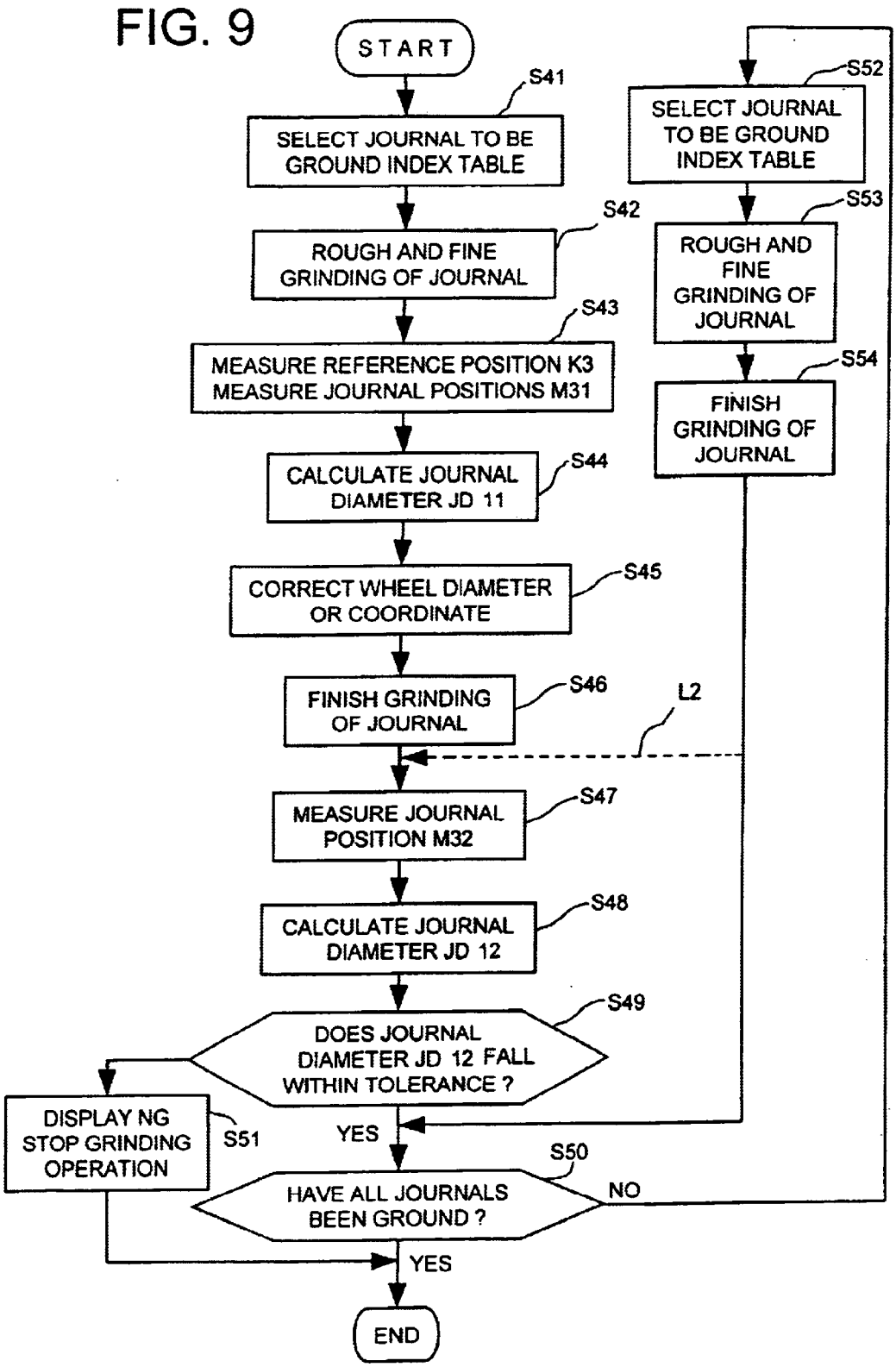
FIG. 9 is a flowchart showing the operation for grinding journal of a crankshaft, while measuring the journal by the third embodiment of the work-portion measuring method of the present invention.

Next, a third embodiment of the work-portion measuring method of the present invention will be described with reference to FIGS. 8 and 9. FIG. 8 is an illustration showing the third embodiment of the work-portion measuring method of the present invention. FIG. 9 is a flowchart showing the operation for grinding a journal portion, while measuring the journal portion by use of the measurement apparatus 25.

A machining operation program which is required to grind the outer circumferential surface of a journal J1 (work portion) of a crankshaft (workpiece) 20 on the grinding machine 1 is stored in the storage unit 36 in advance.

When the machining operation program shown in FIG. 9 is started, in first step S41, the table 11 is moved by the Y-axis motor 12 to a position at which the grinding wheel 7 faces the first journal J1.

In next step S42, the workpiece 20 is rotated by the C-axis motor 17 on the headstock 16, and the wheel head 3 is advanced by the X-axis motor 4 in such a manner that the grinding wheel 7 cuts into the journal J1 to thereby perform rough grinding and fine grinding. At the end of the fine grinding, the cutting feed of the wheel head 3 is stopped, and the workpiece 20 is rotated one turn or several turns in order to effect spark-out grinding. Subsequently, the fine grinding is ended.

In this case, the workpiece 20 deflects during the rough grinding and the fine grinding, so that the finished journal J1 of the workpiece 20 may come to have an elliptical cross section. In order to eliminate an elliptical component, the wheel head 3 may be advanced and retreated over a small distance in synchronism with rotation of the workpiece 20. In the case in which such elliptical-component correction motion is to be imparted to the wheel head 3, first trial grinding is performed in order to obtain the relationship between each rotational angular position of the workpiece 20 and a corresponding correction amount (increase or decrease amount) by which the corresponding movement amount of the wheel head 3 is to be corrected in order to eliminate the elliptical component. The thus-obtained relationship is stored in the storage unit 36 as correction profile (P/F) data. During each grinding step, the correction amount is added to the cutting feed amount of the wheel head 3 in accordance with the correction profile (P/F) data.

In subsequent step S43, the probe 27 of the measurement apparatus 25 is brought into contact with the reference surface of the reference plate 29 provided on the headstock 16. When the measurement apparatus 25 outputs an ON signal, the position of the wheel head 3 is detected from the output of the X-axis encoder 5 and is stored in the storage unit 36 as a reference point K3.

Next, the probe 27 is brought into contact with the first journal J1 having been ground. When the measurement apparatus 25 outputs an ON signal, the position of the wheel head 3 is detected, and the distance in the X-axis direction between the reference point K3 and the position at which the measurement apparatus 25 has output the ON signal is obtained as an outer-circumferential-surface distance M31.

In step S44, the CPU 32 calculates the diameter JD11 of the journal J1 on the basis of the known reference distance K3 and the measured outer-circumferential-surface distance M31. The diameter JD11 of the journal J1 can be obtained by, for example, the formula JD=(K3−M31−P/2)×2.

In subsequent step S45, the measured actual diameter JD of the journal J1 after fine grinding is compared with a target diameter after fine grinding. When the error therebetween is in excess of a preset tolerance, the set value for the wheel diameter is corrected, or the coordinate of the wheel head 3 is corrected.

In the method in which the set value for the wheel diameter is corrected, the main purpose of correction is to compensate thermal deformation of a metal core member of, for example, a CBN grinding wheel and a measurement error in measurement of a wheel diameter, which is performed manually by use of a measurement tool. However, errors stemming from thermal deformation of all mechanical elements which constitute the grinding machine and follow delay of the feed servo system are regarded as errors in setting the wheel diameter; and the set value for the wheel diameter is corrected on the basis of the errors. Specifically, when the actual diameter JD after fine grinding is smaller than the corresponding target diameter, the set value for the wheel diameter is judged to be smaller than an ideal value by an amount corresponding to the difference between the actual diameter and the target diameter. In such a case, the set value for the wheel diameter is reset to a value which is greater than the previous value by an amount corresponding to the difference, and thus, the cutting-feed end position of the wheel head 3 in finish grinding is corrected so as to be shifted rearward or toward the retracted position. When the actual diameter JD after fine grinding is greater than the corresponding target diameter, the set value for the wheel diameter is reset to a value which is smaller than the previous value by an amount corresponding to the difference, and thus, the cutting-feed end positron of the wheel head 3 in finish grinding is corrected to be shifted forward or toward the center of the workpiece 20.

In the method in which the coordinate of the wheel head 3 is corrected, errors due to thermal deformation, measurement errors, and follow delay of the feed servo system are regarded as an error in initial setting of the coordinate of the wheel head 3. In this method, when the actual diameter JD after fine grinding is smaller than the corresponding target diameter, the coordinate of the wheel head 3 is corrected to be shifted forward in the cutting feed direction; and when the actual diameter JD after fine grinding is greater than the corresponding target diameter, the coordinate of the wheel head 3 is corrected to be shifted rearward in the cutting feed direction.

In subsequent step S46, the journal J1 having undergone rough grinding and fine grinding in step S43 is subjected to finish grinding. At the end of the finish grinding, spark-out grinding is performed in the same manner as that performed at the end of the fine grinding. In the case in which the set value for the wheel diameter has been corrected in step S45, during the finish grinding, the wheel head 3 is fed to a cutting-feed end position for finish grinding which is re-calculated on the basis of the corrected wheel diameter. Thus, the journal J1 is finished to have the target finish diameter.

In the case in which the present position coordinate of the wheel head 3 has been corrected in step S45, the coordinate which is contained in the numerical control program and which designates the cutting-feed end position for finish grinding is not changed. However, since the present position coordinate of the wheel head 3 has been corrected, the position of the wheel head 3 at the cutting-feed end position for finish grinding is changed consequently, so that the journal J1 is finished to have the target finish diameter.

After completion of the finish grinding, in step S47, the probe 27 is brought into contact with the journal J1 in a manner similar to that in step S43. When the measurement apparatus 25 outputs an ON signal, the position of the wheel head 3 is detected, and the distance in the X-axis direction between the reference point K3 and the position at which the measurement apparatus 25 has output the ON signal is obtained as an outer-circumferential-surface distance M32.

In step S48, the CPU 32 calculates the diameter JD12 of the journal J1 in the same manner as in step S44.

In step S49, the CPU 32 judges whether the obtained diameter JD12 falls within the tolerances set for the target value to be attained after completion of the grinding operation. When the diameter JD12 falls within the tolerance, the CPU 32 proceeds to step S50. When the diameter JD12 falls outside the tolerance, the CPU 32 proceeds to step S51.

In step S51, the CPU 32 feeds to the input/output unit 38 an NG signal indicating that the ground journal J1 is NG; i.e., unsatisfactory. Upon receipt of the NG signal, the input/output unit 38 displays on the display means a message reporting that the ground journal J1 is NG Further, the CPU 32 transmits a machining stop command to the grinding machine 1, so that grinding of a subsequent journal J2 is stopped.

In step S50, the CPU 32 judges whether all journals have been ground. When no other journals to be ground are present, the CPU 32 ends the processing. When any journal to be ground is present (e.g., journals J2 and J3), the CPU 32 proceeds to step S52.

In step S52, the table 11 is moved by the Y-axis motor 12 to a position at which the grinding wheel 7 faces the second journal J2.

In next step S53, the journal J2 is subjected to rough grinding and fine grinding performed in the same manner as in step S42.

In subsequent step 54, in the same manner as in step S46, the wheel head 3 is advanced to the cutting-feed end position for finish grinding which has been corrected through wheel diameter correction or wheel-head coordinate correction in step S45. Thus, the journal J1 is subjected to finish grinding (micro grinding, grinding without cutting).

Upon completion of the finish grinding, the CPU 32 proceeds to step S50 and ends the grinding work.

In a modification of the third embodiment, the CPU 32 calculates the diameter JD of the journal J1 after completion of the finish grinding. In this case, the CPU 32 is programmed to proceed from step S54 to step S47 as indicated by line L2, so that the processing in step S47 and subsequent steps is performed.

As described above, the work-portion measuring method according to the present invention enables accurate measurement of the diameter of the work portion at low cost. Further, the eccentricity of the work portion with respect to the center axis can be measured. Therefore, when the measuring method of the present invention is employed in a grinding machine, a workpiece can be ground with improved finish accuracy.

The present invention is not limited to the above-described embodiments, and the embodiments may be modified in various ways without departing from the scope of the present invention.

For example, in the embodiments, the present invention is applied to the grinding machine. However, the present invention can be applied to various machine tools other than the grinding machine.

In the embodiments, distance is measured along a single axis (e.g., the X axis). However, the diameter or eccentricity of each work portion can be measured on the basis of distances which are measured two-dimensionally or three-dimensionally.

Further, the operation for grinding a work portion of the workpiece 20 or 21 while measuring the work portion is not limited to these shown in the flowcharts of FIGS. 4, 7, and 9, and may be modified in various manners.

Machining and measurement of crankpins, eccentric cylindrical portions, and journals of a crankshaft have been described. However, no limitation is imposed on the type or shape of the workpiece or work portion, insofar as the workpiece is a rotary object having a center axis (i.e., a shaft-shaped workpiece).

Although in the embodiments a CBN grinding wheel is used for the grinding wheel 7, grinding wheels of other types, such as WA grinding wheel, may be used, and a cutting tool such as a cutter or turning tool may be used.

The measuring method is not limited to those shown in FIGS. 3, 6, and 8, and may be modified in various manners.

In the embodiments, the reference plate 29 is provided on the side surface of the headstock 16. However, the position and shape of the reference plate 29 can be changed freely, insofar as the reference plate 29 enables determination of a reference position with respect to the axis of the main spindle center 19.

In the embodiments, each of work portions of workpieces has a circular cross section. However, the measuring method according to the present invention can be applied to work portions whose cross sections have a shape other than circular.

The two points on the outer circumferential surface of a work portion at which the probe 27 of the measurement apparatus 25 is brought into contact with the surface are freely determined in such a manner that the selected two points are located at diametrically opposite positions with respect to the rotation center (the selected two points are separated from each other by 180 degrees in the circumferential direction).

The measurement apparatus 25 used in the above-described embodiments is of a contact operation type; i.e., the measurement apparatus 25 outputs an ON signal when the probe 27 inclines by a predetermined angle due to contact with a work portion to be measured. However, measurement apparatuses of other types may be used. For example, a measurement apparatus which can detect movement of a probe within a relatively small range but with a high resolution of, for example, 0.1 or 1 micrometer. When such an measurement apparatus is used, the reference point on the reference plate 29 is memorized as follows. The wheel head 3 is advanced by a predetermined movement amount in order to bring the probe into contact with the reference plate 29, and the amount of movement of the probe at that time is detected from the output of the measurement apparatus, and the sum of the predetermined amount of movement of the wheel head 3 and the detected amount of movement of the probe is obtained and is stored as a reference point. Further, the distance between the reference point and the surface of each work portion (e.g., M11, M12 in FIG. 2) is obtained as follows. The wheel head 3 is advanced by a predetermined amount of movement in order to bring the probe into contact with the work portion, and the amount of movement of the probe at that time is detected from the output of the measurement apparatus, and the sum of the predetermined amount of movement of the wheel head 3 and the detected amount of movement of the probe is obtained and stored as the distance between the reference point and the surface of the work portion.

In place of the measurement apparatus 25, other types of measurement apparatuses such as an ultrasonic sensor and an optical sensor may be used, insofar as the selected measurement apparatus can accurately detect the surface of the reference plate 29 or the surface of a work portion to be measured.

Further, the measuring method of the present invention can be applied to a grinding machine for grinding a camshaft. Specifically, the measuring method of the present invention can be used to measure the shape of a cam after completion of grinding operation; in particular, the radius of the base circle of the cam, and the radius of the top portion as measured from the center of the base circle or to measure the position of the surface of a ground cam at a plurality of positions to thereby check the cam profile. Similarly, the measuring method of the present invention can be used to measure the position of the surface of a ground cylindrical portion at a plurality of positions to thereby measure the roundness of the ground cylindrical portion on the machine. Moreover, when the measuring method of the present invention is used to measure a concentric cylindrical portion, an eccentric cylindrical portion, or a crankpin portion of a workpiece set on the grinding machine before performance of grinding operation, it becomes possible to check beforehand whether grinding allowance is sufficient and/or whether each workpiece is defective, thereby enabling ejection of defective workpieces before start of grinding operation.

In the above-described embodiment, the probe 27 is formed into the shape of a sphere having a diameter P. However, the shape, material, length, number, etc. of the probe may be changed.

In the above-described embodiment, the center of the probe 27 is used as a measurement position of the measurement apparatus. However, any other position within the probe 27 may be used as a measurement position. The measurement apparatus 25 is preferably mounted on a tool head such as the wheel head 3.

In the above-described embodiment, the control apparatus 31 is a computerized numerical controller (CNC). However, a controller of any other type may be sued. In the above-described embodiment, ideal profile (P/F) data, corrected (or correction) profile (P/F) data, and re-corrected profile (P/F) data are stored in the storage unit 36. However, the types of data and programs stored in the storage unit 36 are not limited thereto.

What is claimed is:

1. A work-portion measuring method for measuring a diameter of a cylindrical work portion of a workpiece mounted on a machine tool, the work portion being concentric with a rotation center of the workpiece, the method comprising:

setting a first distance between a rotation center of the workpiece and a reference point provided on the machine tool;

rough grinding the workpiece until a rough-grinding end position is met;

measuring a second distance between the reference point and an outer circumferential surface of the work portion after the rough grinding step;

obtaining a new diameter of the work portion on a basis of the first and second distances; and finish grinding the workpiece based on the new diameter obtained in the obtaining step.

2. A machining method for machining an outer circumferential surface of a cylindrical work portion of a workpiece mounted on a machine tool in accordance with a machining program, the work portion being concentric with a rotation center of the workpiece, the method comprising:

setting a first distance between a rotation center of the workpiece and a reference point provided on the machine tool;

rough grinding the workpiece until a rough-grinding end position is met;

measuring a second distance between the reference point and an outer circumferential surface of the work portion after the rough grinding step;

obtaining a new diameter of the work portion on the basis of the first and second distances;

correcting the machining program based on the new obtained diameter of the work portion; and finish grinding the outer circumferential surface of the work portion in accordance with the corrected machining program.

3. The machining method according to claim 2, further comprising comparing the obtained new diameter of the work portion with a tolerance to judge whether the work portion is good.

4. A work-portion measuring method for measuring a diameter and eccentricity of a cylindrical work portion of a workpiece mounted on a machine tool, the work portion being eccentric with respect to a rotation center of the workpiece, the method comprising:

setting a first distance between the rotation center of the workpiece and a reference point provided on the machine tool;

rough grinding the workpiece until a rough-grinding end position is met;

measuring a second distance between the reference point and an innermost point on an outer circumferential surface of the work portion after the rough grinding step;

measuring a third distance between the reference point and an outermost point on the outer circumferential surface of the work portion;

obtaining a new diameter and eccentricity of the work portion on a basis of the first, second, and third distances; and finish grinding the workpiece based on the new diameter obtained in the obtaining step.

5. A machining method for machining an outer circumferential surface of a cylindrical work portion of a workpiece mounted on a machine tool in accordance with a machining program, the work portion being eccentric with a rotation center of the workpiece, the method comprising:

setting a first distance between the rotation center of the workpiece and a reference point provided on the machine tool;

rough grinding the workpiece until a rough-grinding end position is met;

measuring a second distance between the reference point and an innermost point on an outer circumferential surface of the work portion after the rough grinding step;

measuring a third distance between the reference point and an outermost point on the outer circumferential surface of the work portion;

obtaining a new diameter and eccentricity of the work portion on a basis of the first, second, and third distances;

correcting the machining program based on the obtained new diameter and eccentricity of the work portion; and finish grinding the outer circumferential surface of the work portion in accordance with the corrected machining program.

6. The machining method according to claim 5, further comprising comparing one of the obtained new diameter and eccentricity of the work portion with a tolerance to judge whether the work portion is good.

* * * * *